US008678625B2

(12) United States Patent
Garvin

(10) Patent No.: US 8,678,625 B2
(45) Date of Patent: Mar. 25, 2014

(54) BLANKING DEVICE FOR RECESSED CEILING LIGHTING FIXTURES

(76) Inventor: Barton L. Garvin, Western Springs, IL (US)

( * ) Notice: Subject to any disclaimer, the term of this patent is extended or adjusted under 35 U.S.C. 154(b) by 167 days.

(21) Appl. No.: 13/359,364

(22) Filed: Jan. 26, 2012

(65) Prior Publication Data

US 2013/0194813 A1 Aug. 1, 2013

(51) Int. Cl.
*F21V 15/04* (2006.01)

(52) U.S. Cl.
USPC ..... 362/369; 362/365

(58) Field of Classification Search
USPC ..... 362/95, 147, 365, 369
See application file for complete search history.

(56) References Cited

U.S. PATENT DOCUMENTS

2013/0194813 A1* 8/2013 Garvin ..... 362/369

* cited by examiner

*Primary Examiner* — David V Bruce
(74) *Attorney, Agent, or Firm* — David G. Rosenbaum; J. Peter Paredes; Rosenbaum IP

(57) ABSTRACT

A ceiling blank configured to cover recessed canister lighting fixtures. A body member covers the open end of the fixture while an attachment apparatus secures the body member against the open end of the fixture. The attachment apparatus includes a fixture fitting that engages with a threaded aperture, such as a light socket, and a tension member provides tension force between the fixture fitting and the body member, forcing the body member against the open end of the fixture.

21 Claims, 2 Drawing Sheets

BLANKING DEVICE FOR RECESSED CEILING LIGHTING FIXTURES

BACKGROUND OF THE INVENTION

Recessed lighting is a popular design for light fixtures. A recessed light is a light fixture that is installed into a hollow opening in a ceiling. The housing for the fixture often takes the form of a canister, with one end housing the light socket and the other end being open and directed towards the floor or wall. A light bulb installed into the canister light will face towards the floor, and the canister housing will direct the light towards the floor.

Due to the nature of recessed lighting generally, and canister lights specifically, the ceiling must be altered to accommodate the fixture. Often, this includes removing a portion of the ceiling to form a hollow within which the fixture is disposed. When the design for lighting a room in which the canister light has been installed changes, removal of the canister light would reveal the hollow in the ceiling. Patching the hollow usually requires the service of a professional, increasing the cost of removing the fixture. Additionally, the time required to patch the hollow can be significant. Moreover, a patch applied to a ceiling a period of years after the installation of the original ceiling is often aesthetically displeasing. However, simply leaving the canister light is often undesirable for similar aesthetic reasons, potential electrical and fire hazards, as well as causing the loss of heated or cooled air through an opening to the ceiling. As such, there is a need for an apparatus capable of disguising or otherwise covering and concealing a recessed light fixture at a low cost, without the need for professionally-provided service, in a timely manner.

SUMMARY OF THE INVENTION

The present invention is a ceiling blank that covers the open surface of the recessed light fixture that is directed towards the floor or wall. The ceiling blank is comprised of a generally flat body member having at least one securing member attached thereto and an attachment apparatus for attaching the body member to the recessed light fixture. In one embodiment, the attachment apparatus includes at least one tension member associated with each securing member of the body member and a fixture fitting configured to engage with the securing member. In a further embodiment, the invention includes a plurality of securing members as well as a plurality of tension members. In yet a further embodiment of the invention, the body member includes a scoring forming a frangible section of the body member. In yet a further embodiment of the invention, a surface of the generally flat section of the body member has a coating, the coating being optionally colored.

The foregoing and other features and advantages of the invention are apparent from the following detailed description of exemplary embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PREFERRED EMBODIMENTS

Figure 1:
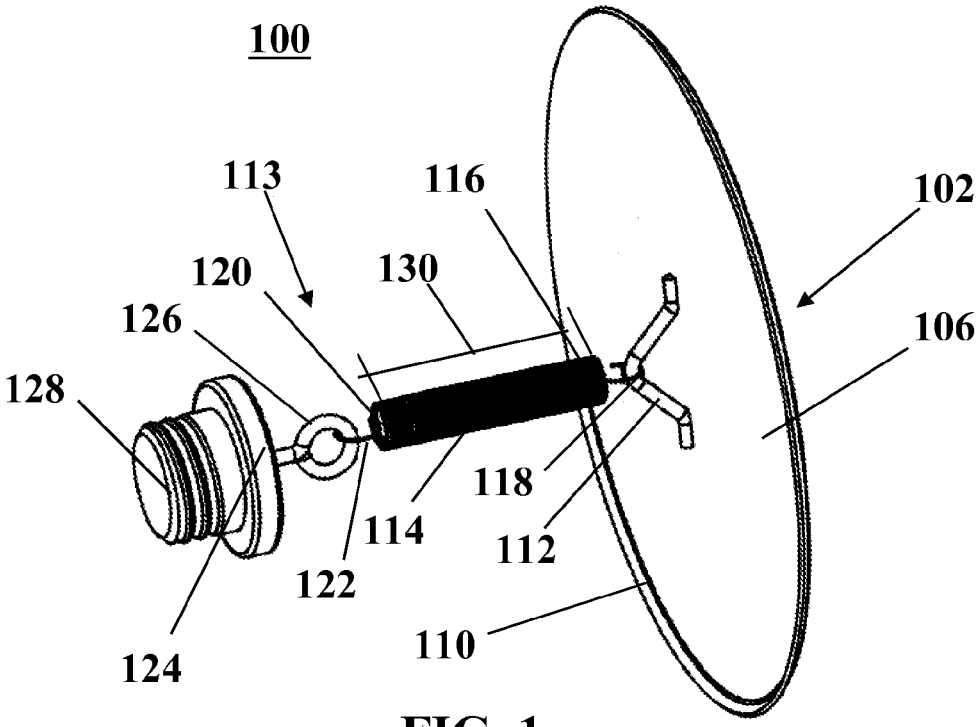
FIG. 1 is a perspective view of an embodiment of the invention.

An embodiment of the invention is depicted in FIG. 1. In that embodiment, the ceiling blank 100 comprises a generally flat body member 102. The body member 102 can comprise a first surface 106 and a second surface 108 (see FIG. 3) opposite the first surface. Body member 102 can be configured into any generally flat shape, such as a circle, ellipse, triangle, square, rectangle, or any other polygon. Moreover, the diameter or center-to-edge distance of body member can be selectively configured. For example, but not by limitation, a circular body member can have a diameter of about 1 inch to about 12 inches, such that some embodiments include a circular body member having a diameter of about 2 inches, about 3 inches, about 4 inches, about 5 inches, about 6 inches, about 7 inches, about 8 inches, about 9 inches, about 10 inches, or about 11 inches. The body member 102 can further comprise a lip 110 about the perimeter of the body member 102. The body member 102 may be fabricated from a metal, such as aluminum, iron, steel, stainless steel, bronze, brass, copper, nickel, tin, or alloys thereof. The body member can also be fabricated from a polymer, such as polypropylene, melamine formaldehyde, polyurethane, and acrylonitrile-butadiene-styrene, as well as all other suitable polymers exhibiting substantial rigidity.

In another embodiment, body member 102 further comprises a securing member 112 attached to one of the first surface 106 and the second surface 108, or both. The securing member 112 is attached to the first surface 106 or the second surface 108 by any suitable method providing a strong attachment not likely to fail due to building vibration or oxidation processes, including, for example, adhesives, welding, brazing, and soldering. Furthermore, in the present embodiment, the securing member 112 is a v-bracket. However, any other bracket shape, such as c-brackets and u-brackets, as well as alternative securing members, such as hooks, magnets, threaded matings for a screw, and engaging couplings are included in the invention. In the present embodiment, securing member 112 is attached at about the center of first surface 106.

Each of the body member 102 and securing member 112 may optionally include a coating. The coating may be decorative and/or functional. For example, the coating material may have desirable corrosion properties, it may be water repellant, and it may be non-conductive. The coating may also have a desired color or pattern, texture, reflectivity, or acoustic properties.

Ceiling blank 100 further comprises an attachment apparatus 113. In the present embodiment, the attachment apparatus 113 comprises a tension member 114 and a fixture fitting 124. Tension member 114 is associated with securing member 112; each tension member 114 is associated with at least one securing member 112. Tension member 114 can be any device or structure configured to provide a tension force, such as a spring, a screw, and a length of elastic material such as rubber or rubber composites. Tension member 114 has a proximal end 116 comprising a proximal attachment member 118 and a distal end 120 comprising a distal attachment member 122. Proximal attachment member 118 of proximal end 116 is associated with securing member 112 and is an attachment means configured to engage with securing member 112. Such configurations can include hooks, eye-hooks, clasps, latches, screws, threaded matings for screws, and magnets, as well as any other attachment means that is not likely to fail under the tension force exerted by tension member 114. Distal attachment member 122 is also an attachment means configured into any of the aforementioned configurations. In the present embodiment, proximal attachment member 118 is configured as a hook and engages with the securing member 112. Tension member 114 has a longitudinal length 130 configured to simultaneously engage with both body member 102 and fixture fitting 124 and exert a tension force on both when deployed.

Attachment apparatus 113 further comprises a fixture fitting 124 comprising a proximal attachment member 126 and a distal attachment section 128. Proximal attachment member 126 is associated with a distal attachment member 122 of at least one tension member 114 and is an attachment means configured to engage with distal attachment member 122. Such attachment means include hooks, eye-hooks, clasps, latches, screws, and magnets, or any other suitable fastener not likely to fail when under the tension force exerted by tension member 114. In the present embodiment, proximal attachment member 126 is configured as an eye-hook and engages with distal attachment member 122, which is configured as a hook.

Distal attachment section 128 is configured to engage with a light socket external ceiling blank 100. In the present embodiment, distal attachment section 128 is threaded and configured to engage with a receiving coupling, such as a light socket. The receiving coupling may be a threaded aperture or an engaging coupling, such as a pin and socket coupling, a bi-pin coupling, or a bayonet coupling. In other embodiments, the distal attachment section 128 may be configured to attach to other points of attachment such as plumbing, HV/AC, nails, and screws. The threads used can be of any angle, lead, pitch, and start as is required to engage with a given light socket such as, but not by limitation, from E5 to E39. Other configurations of distal attachment section 128 include bi-pin, bayonet mount, and wedge base, as well as any other light socket.

Fixture fitting 124 is fabricated out of a non-conductive, electrically insulating material. Such materials include polymers, such as PVC and HDPE, as well as synthetic and non-synthetic rubbers.

Figure 2:
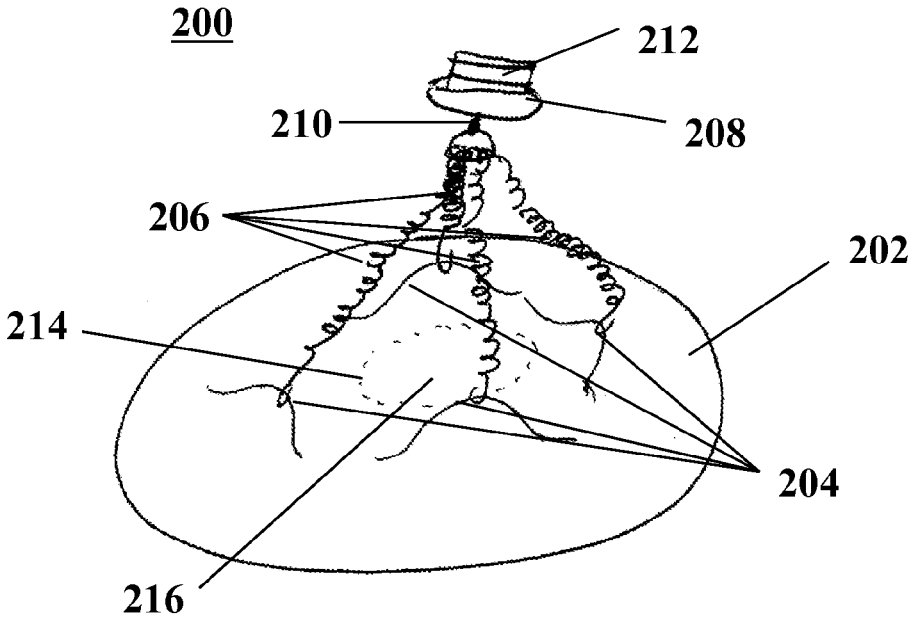
FIG. 2 is a perspective view of another embodiment of the invention.

A second embodiment is depicted in FIG. 2. The ceiling blank 200 comprises a generally flat body member 202 as in FIG. 1, having first and second surfaces as well as a lip about the perimeter of the body member 202. However, ceiling blank 200 comprises more than one securing member; in this embodiment, there are four securing members 204. The invention includes any number of securing members 204. The securing members 204 are attached to one of the first or second surfaces, or both, co-circularly about the center of the body member 202, such that each is the same radial distance away from the center of the body member 202. In other embodiments, the securing members 204 can be distributed according to any other pattern or randomly. Associated with each of the securing members 204 is a tension member 206 identical to the tension member 114 of FIG. 1. Each of the tension members 206 is engaged with its associated securing member 204.

As in the embodiment of FIG. 1, ceiling blank 200 includes a fixture fitting 208 including a proximal attachment member 210 and a distal fitting section 212. In the present embodiment, proximal attachment member 210 and distal fitting section 212 are the same as in the embodiment of FIG. 1. However, in this embodiment, proximal attachment member 210 is associated with more than one tension member 206; it is associated and engaged with each of the four tension members 206. Although the tension members 206 engage with fixture fitting 208 via a single proximal attachment member 210, fixture fitting 208 can be configured to have two or more proximal attachment members 210, each associated with one or more tension members 208.

Ceiling blank 200 also comprises scoring 214 disposed within the body member 202. The scoring 214 is configured to define the boundary of a frangible section 216 of the body member 202. The scoring 214 enables the removal of the frangible section 216 by causing the body member 202 to break at the boundary of the frangible section 216 when an incidental force is exerted on the frangible section 216. The frangible section 216 may include any part of the body member 202. In some embodiments, the frangible section 216 will include the center of the body member 202, and may be centered about the center of body member 202. The frangible section 216 is configured to a circle, and may configured to be any shape, including a triangle, a square, a rectangle, or any other polygon. One or more securing members 204 may be partially or wholly within the boundary of the frangible section 216, or none may be within the boundary.

Example 1

Figure 3:
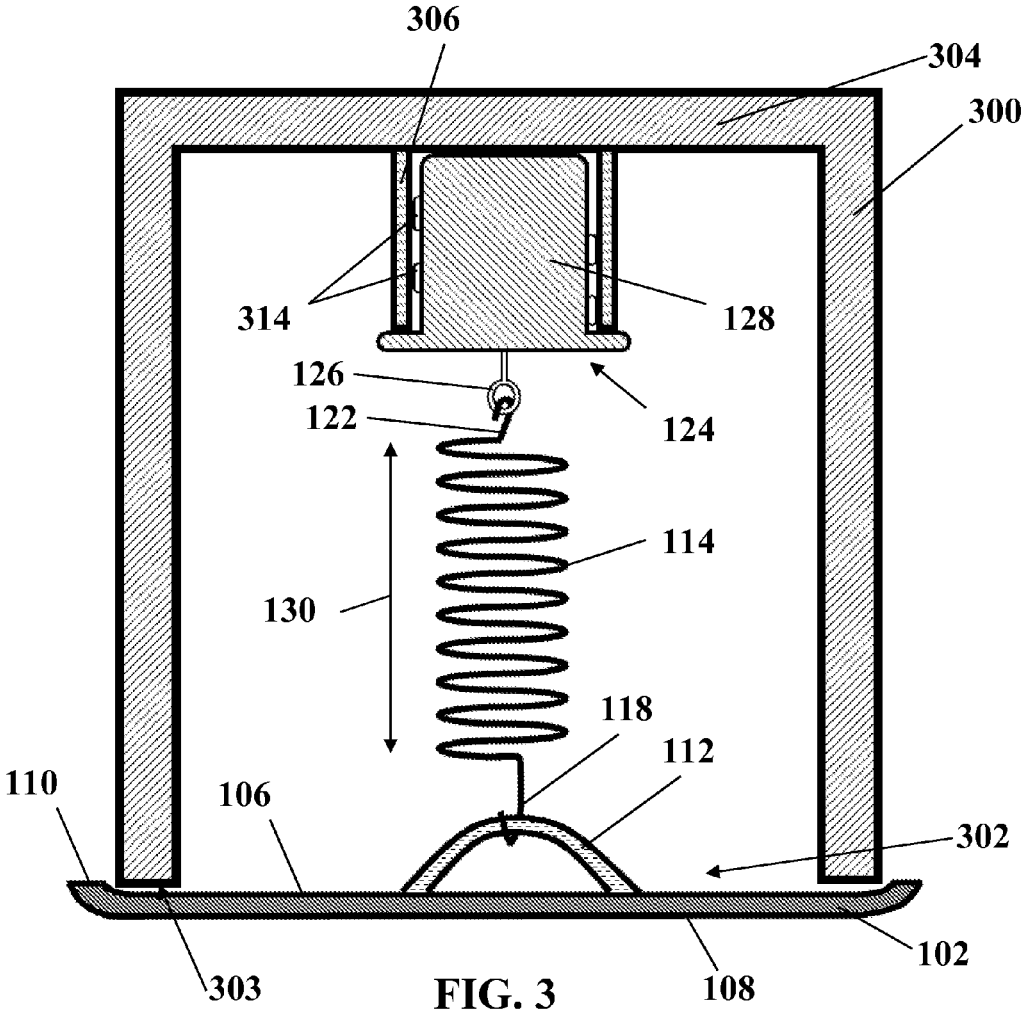
FIG. 3 is a cross-sectional view of the embodiment of the invention as shown in FIG. 1 when deployed in a canister light fixture.

In FIG. 3, the embodiment shown in FIG. 1 is employed in covering a standard canister light fixture. A canister light fixture 300 comprises a hollow cylinder with an open end 302 having a lower surface 303 and a closed end 304 opposite the open end 302, with a light socket 306 disposed on the inside surface of the closed end 304, extending in the direction of the open end 302. Body member 102 is configured as a circle, conforming to the open end 302 of the canister light fixture 300. The diameter of body member 102 depends on the size of the open end of the canister fixture; body member 102 has a diameter greater than the open end of the canister, so as to cover the open end 302. When the diameter of body member 102 is greater than the diameter of the open end 302, the lip 110 of the body member 102 abuts the lower surface 303 of the open end 302. In alternative embodiments, body member 102 may be so configured as to only partially cover the open end 302 of the canister light fixture 300. Additionally, distal attachment section 128 is configured to have threads 314, so as to mate with the canister fixture light socket 306.

To deploy the ceiling blank, distal attachment section 128 is first engaged with the canister fixture light socket 306 by turning the distal attachment section 128 to mate with the canister fixture light socket 306. Once engaged, tension member 316 engages with fixture fitting 124 as described hereinabove. Longitudinal length 130 of the tension member 114 is configured to accommodate the longitudinal length of the canister light fixture 300 as well as to provide a sufficient tension force necessary to press body member 102 against the lower surface 303 of the canister light fixture 300. In further embodiments, the body member 102 may press against an exterior wall surface or the edge of a light fixture 300. When the tension force is exerted, body member 102 is pressed against the lower surface 303 of the canister light fixture 300, causing lip 110 to extend beyond the lower surface 303 of the canister light fixture 300, thereby completely covering the open end 302.

Example 2

The embodiment as shown in FIG. 2 can also be employed in covering a standard canister light fixture. The deployment of the embodiment of the invention as depicted in FIG. 2 is essentially the same as in Example 1, with the exceptions of the multiple securing members, multiple tension members, and the presence of the scoring. Once fixture fitting 208 has engaged with the light socket of the canister fixture, each of the tension members 206 may be engaged with its associated securing member 204 and then the proximal attachment member 210. Finally, body member 202 may be positioned so as to cover the open end of the canister fixture, and tension members 206 can impart a tension force on body member 102, thereby forcing body member against the lip of the open end of the canister fixture, thereby covering the open end.

Frangible section 216 may be removed from body member 202 by pressing against frangible section 216. Scoring 214 will facilitate the detachment of frangible section 216 from body member 202 by reducing the force necessary to cause the body member 202 to break about the boundary of the frangible section 216. Once frangible section 216 is removed, a pendant fixture may optionally be hung in the canister light fixture. In further embodiments, cords and/or cables may be affixed to the body member 202. Furthermore, removal of frangible section 216 also facilitates removal of ceiling blank 200 by permitting easier access to tension members 206, securing members 204, and proximal attachment member 210.

While the invention has been described with respect to certain specific embodiments, it will be appreciated that many modifications and changes may be made by those skilled in the art without departing from the spirit of the invention.

What is claimed is:

1. A blanking device comprising:

a generally flat body member having a first surface, a second surface, and a perimeter;

a securing member attached to the first surface of the body member;

a fitting member configured to engage with a receiving coupling; and a tension member coupled to the securing member and to the fitting member.

2. The blanking device of claim 1, wherein the tension member comprises at least one of a spring, a screw, and an elastic member.

3. The blanking device of claim 1, wherein the tension member comprises a spring having a proximal attachment member and a distal attachment member, wherein the proximal attachment member is associated with the securing member and the distal attachment member is configured to engage with the fitting member.

4. The blanking device of claim 3, wherein the proximal attachment member and distal attachment member are an attachment means selected from the group consisting of hooks, eye-hooks, clasps, latches, screws, threaded matings for screws, and magnets.

5. The blanking device of claim 3, wherein the proximal attachment member and the distal attachment member are the same attachment means.

6. The blanking device of claim 3, wherein the proximal attachment member and the distal attachment member are different attachment means.

7. The blanking device of claim 1, wherein the fitting member comprises a proximal attachment member and a distal attachment section.

8. The blanking device of claim 7, wherein the proximal attachment member is an attachment means selected from the group consisting of hooks, eye-hooks, clasps, latches, screws, threaded matings for screws, and magnets.

9. The blanking device of claim 7, wherein the distal attachment section is configured to engage with a light fixture.

10. The blanking device of claim 9, wherein the distal attachment section comprises a configuration selected from the group consisting of a threaded base, a bi-pin connector, a bayonet mount, and a wedge base.

11. The blanking device of claim 1, wherein the tension member is configured to have a longitudinal length that creates a tension force that acts on the body member.

12. The blanking device of claim 1, wherein the securing member is attached to the body member at about a center of the first surface of the body member.

13. The blanking device of claim 1, further comprising a plurality of securing members attached co-circularly to the body member at a distance from the center of the first surface of the body member.

14. The blanking device of claim 13, further comprising a plurality of tension members, each of the plurality of tension members being associated with one of the plurality of securing members.

15. The blanking device of claim 1, wherein the body member is formed into a circle.

16. The blanking device of claim 1, further comprising a lip about the perimeter of the body member.

17. The blanking device of claim 1, wherein the fitting member is fabricated from an insulating material.

18. A light fixture blanking device comprising:

a generally flat body member having a first surface, a second surface, and a lip about the perimeter of the body member;

scoring formed within the body member;

a plurality of securing members attached to the first surface of the body member;

a fitting member configured to engage with a light socket; and at least one of a plurality of tension members coupled to at least a first securing member of the plurality of securing members and the fitting member;

whereby the body member is tensioned against a lower portion of the fixture.

19. The blanking device of claim 18, wherein the scoring forms a boundary for a frangible section of the body member.

20. The blanking device of claim 19, wherein the frangible section is centered at about the center of the body member.

21. The blanking device of claim 19, wherein at least one of the plurality of securing members is attached outside the boundary of the frangible section of the body member.

* * * * *